United States Patent [19]

Fong

[11] 4,038,786

[45] Aug. 2, 1977

[54] SANDBLASTING WITH PELLETS OF MATERIAL CAPABLE OF SUBLIMATION

[75] Inventor: Calvin C. Fong, Beverly Hills, Calif.

[73] Assignee: Lockheed Aircraft Corporation, Burbank, Calif.

[21] Appl. No.: 608,165

[22] Filed: Aug. 27, 1975

Related U.S. Application Data

[63] Continuation-in-part of Ser. No. 509,916, Sept. 27, 1974, abandoned, which is a continuation-in-part of Ser. No. 306,154, Nov. 13, 1972, abandoned.

[51] Int. Cl.[2] ..... B24C 1/00; B24C 7/00

[52] U.S. Cl. ..... 51/320; 51/439; 51/322

[58] Field of Search ..... 51/8 R, 9 R, 11, 12, 51/13, 319, 320, 321, 314, 322; 317/2 R

[56] References Cited

U.S. PATENT DOCUMENTS

| | | | |
|---|---|---|---|
| 2,666,279 | 1/1954 | Chalom | 51/11 |
| 3,110,983 | 11/1963 | Moore | 51/9 R |
| 3,137,101 | 9/1964 | Leliaert | 51/13 |
| 3,160,993 | 12/1964 | McCormick | 51/9 R |
| 3,324,605 | 6/1967 | Lester | 51/314 |
| 3,422,580 | 1/1969 | Balz | 51/314 |
| 3,485,074 | 12/1969 | Compton | 51/12 X |
| 3,675,374 | 7/1972 | Wilder | 51/12 |
| 3,676,963 | 7/1972 | Rice | 51/320 |
| 3,702,519 | 11/1972 | Rice | 51/320 X |
| 3,768,210 | 10/1973 | Johnson | 51/12 |
| 3,864,602 | 2/1975 | Feder | 317/2 R |

*Primary Examiner*—Gary L. Smith
*Attorney, Agent, or Firm*—Billy G. Corber; Lowell G. Turner; Edward D. O'Brian

[57] ABSTRACT

Effective utilization of pellets of material capable of subliming under conditions of use in a sandblasting process in which such pellets are propelled against a surface by a stream of pressurized gas requires careful control of a number of interrelated factors. When the process is employed for the purpose of removing material from a surface the pellets used should preferably have sharp edges and corners. Further, they should be employed so that they will hit against such a surface as rapidly as reasonably possible. Preferably these pellets are both agitated and subjected to alpha radiation as they are held prior to being entrained into a stream of moving gas and as they are introduced into such a stream. Further, preferably the particles are discharged against the surface being treated through a so-called "sonic nozzle" so as to maximize their momentum as they are directed toward the surface being treated. It is considered that all of these expedients should be used together in obtaining preferred results with the invention.

5 Claims, 1 Drawing Figure

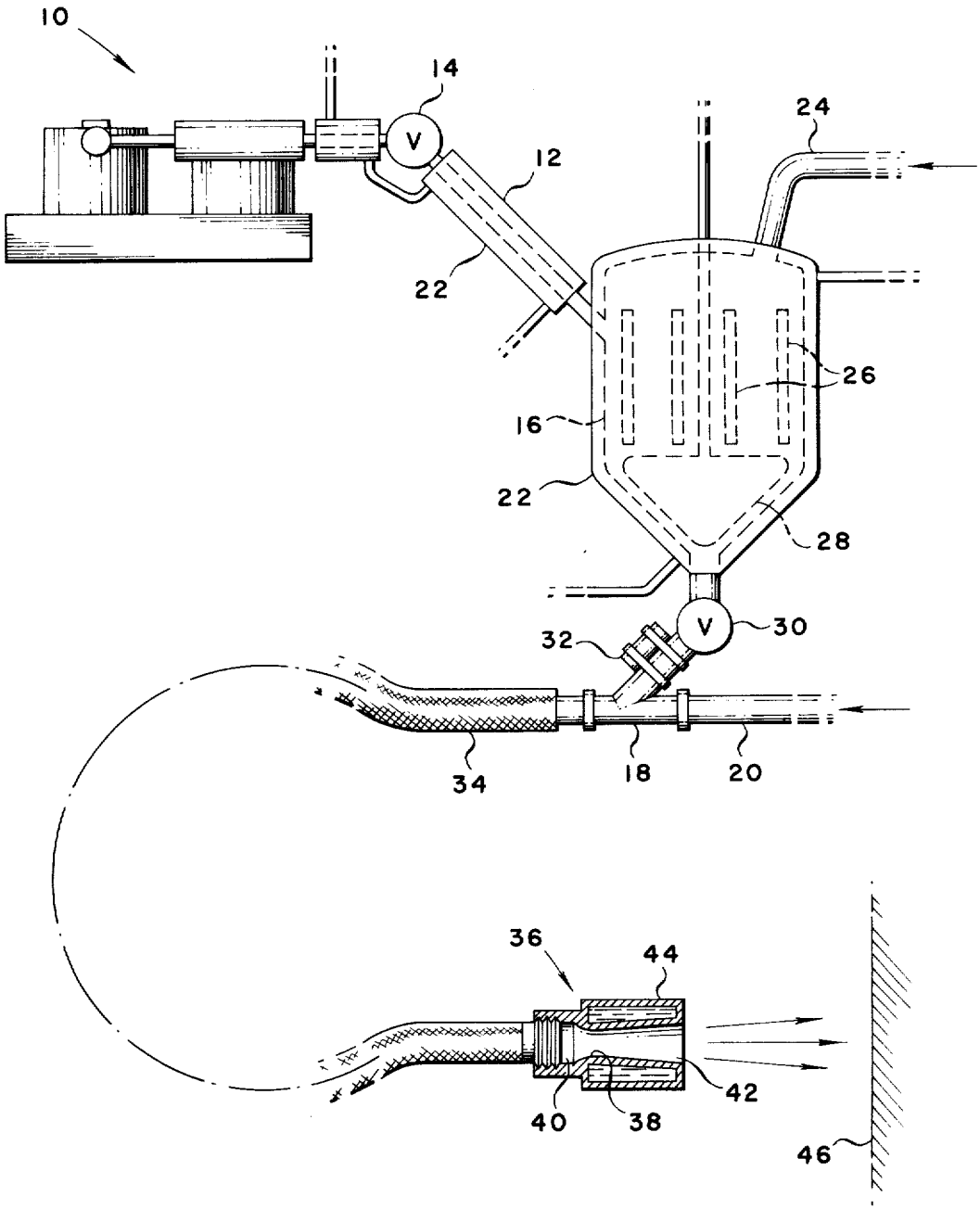
10
14
V
12
24
22
26
16
22
28
V
30
32
34
18
20
36
44
42
40
38
46

SANDBLASTING WITH PELLETS OF MATERIAL CAPABLE OF SUBLIMATION

CROSS REFERENCE TO RELATED APPLICATIONS

This application sets forth and claims subject matter which was set forth and claimed in the now abandoned Calvin C. Fong U.S. patent application Ser. No. 306,154 filed Nov. 13, 1972 entitled SURFACE TREATMENT PROCESS. This application also sets forth and claims subject matter which is set forth and claimed in the now abandoned co-pending Calvin C. Fong U.S. patent application Ser. No. 509,916 filed Sept. 27, 1974 entitled METHOD OF 'SANDBLASTING' WITH DRY ICE. This co-pending application Ser. No. 509,916 was co-pending with the application Ser. No. 306,154 and was a continuation in part of the application Ser. No. 306,154, now abandoned. The present application is a continuation-in-part of the co-pending application Ser. No. 509,916. The entire disclosures of both of these applications Ser. Nos. 306,154 and 509,916 are incorporated herein by reference.

BACKGROUND OF THE INVENTION

The invention set forth in this specification pertains to sandblasting with pellets of material or materials capable of sublimation.

"Sandblasting" is considered to be a generic term used to designate any of a series of processes in which pellets or particles are propelled against a surface by entrainment within a stream of pressurized gas so as to effect a change at or on such a surface. Conventional sandblasting is commonly utilized for cleaning various different types of surfaces of various different types of contaminants. On occasion sandblasting is utilized for other purposes such as, for example, to alter a physical condition of a material adjacent to the surface of the material. Thus, the term "sandblasting" is occasionally utilized to designate various peening processes in which particles are propelled against a metal surface in order to develop desired physical properties within such a surface.

It has been recognized that the use of particles which are solid under normal ambient conditions in sandblasting processes is disadvantageous because of problems relating to cleaning up such particles after they have been used in sandblasting and problems relating to the possibility of atmospheric contamination. Such recognition has led to a recognition of the desirability of utilizing solid carbon dioxide or dry ice particles in sandblasting processes.

It has been considered that the use of such dry ice particles in sandblasting would be advantageous because such solid carbon dioxide particles will disappear as a gas after having been used in sandblasting. Obviously there are no cleanup problems attendant to the removal of gaseous carbon dioxide after a surface has been sandblasted with solid carbon dioxide particles. Further, gaseous carbon dioxide only presents a minimal atmospheric pollution problem inasmuch as ambient air contains carbon dioxide and inasmuch as carbon dioxide gas is readily dispersed within ambient air.

Although the theory behind the use of solid carbon dioxide particles for sandblasting is considered to be basically sound a number of problems have been encountered in effectively sandblasting with dry ice pellets. These problems have primarily concerned the uniform entrainment of such particles within a compressed gas stream under such conditions that the particles are uniformly applied by the gas stream through a nozzle against a surface in such a manner as to maximize the effect of the particles at or on the surface. Perhaps this can best be illustrated by referring to certain problems as have been encountered in sandblasting with carbon dioxide pellets.

One of these problems has concerned the fact that the impingement of a dry ice particle against a surface will normally have a somewhat limited effect at or on the surface as a consequence of the limited density of the particle and as a consequence of the usual or normal somewhat rounded edge and corner configurations of such a particle. Further, the results achieved in sandblasting with dry ice pellets or particles have tended to be somewhat non-uniform as a result of such particles or pellets not feeding in a consistent, uniform manner into streams of compressed gas. To a large extent the latter is related to the fact that such pellets have tended to agglomerate or clump together before and as they have been distributed into a stream of compressed gas. As a consequence of this the pellet or particle content of a gas stream used will vary and will not be consistent. This will tend to make it impossible to minimize the time required to treat a surface with such pellets or particles to the maximum desired extent. On occasion this may even render a sandblasting process using dry ice particles inoperative from a practical standpoint. While to a degree such agglomeration of particles or pellets can be regulated by regulating the purity of the pellets or particles used this expedient is not considered to completely remedy the noted problem.

SUMMARY OF THE INVENTION

It is believed that it will be apparent from the preceding that there is a need for improvement in the field of sandblasting with pellets or particles of solid carbon dioxide. A broad or basic objective of the present invention is to fulfill this need by providing a new and improved process for sandblasting with the noted material which is more desirable than prior related processes. As used herein this term "desirable" is intended to indicate a process in accordance with this invention; which may be easily and conveniently carried out with a minimum of difficulty; which provides for uniform, consistent surface treatment within a minimum time period; and which maximizes the effect or effects achieved on a surface within such a time period.

The invention is, however, broader than the mere use of solid carbon dioxide or dry ice particles or pellets in sandblasting. An object of the present invention is to extend the utility of sandblasting processes so as to make such processes practical for use with other materials than solid carbon dioxide which will sublime after a surface has been treated. Such other materials include many organic compounds which are known to sublime under ambient conditions. Certain of such organic compounds can be utilized not only to effect a change at a surface as a result of a physical action as in conventional sandblasting but can also be utilized to effect a surface change as a result of a chemical or chemical type action. As an example of this such other compounds can on occasion be utilized so as to facilitate removal of an organic coating by (1) tending to abrade such coating and (2) tending to exercise a solvent action to facilitate the breakdown of such a coating.

In accordance with this invention it is considered that effective results are best achieved by providing a method in which solid pellets are entrained in a stream of pressurized gas in a conduit and are propelled by and/or with the gas by a nozzle out of the conduit against a surface in which the improvement comprises: said particles being solid particles of a material which will sublime after engaging the surface, the nozzle being contoured to maximize the flow momentum of the particles by producing a local static pressure at the exit of the nozzle which is equal to the static pressure in the surrounding environment.

It is considered that most satisfactory results can be achieved by agitating the particles or pellets as they are being held prior to being entrained into the stream of gas and as they are introduced into this stream. It is also considered preferable to subject such particles or pellets to alpha radiation as they are being stored and as they are being entrained within a stream of gas as indicated so as to tend to discharge any static charges on such particles which might cause such particles to adhere together.

When the invention is utilized in causing abrasion of a surface it is considered preferable to use pellets or particles which are relatively dense and which have sharp edges and corners as they engage such a surface. Because of the manner in which materials sublime from a solid at edges and corners the latter is considered to make it necessary that the pellets or particles be produced with a configuration as noted and that these pellets be used rapidly after they are produced so that they will engage such a surface before the shapes of these edges and corners are changed.

BRIEF DESCRIPTION OF THE DRAWING

A summary such as the preceding cannot be expected to indicate many important facets of an invention such as the present. Further details of this invention are best more fully explained with reference to the accompanying drawing in which:

The FIGURE is a diagrammatic view illustrating a presently preferred manner of practicing the invention.

This drawing is only intended to illustrate one presently preferred manner of practicing the invention set forth in this specification. From a consideration of the appended claims defining the principles or features of the invention it will be recognized that this invention can be utilized in different manners in differently appearing equipment.

DETAILED DESCRIPTION

In the present preferred manner of practicing the invention the pellets or particles used are solid carbon dioxide or dry ice particles produced by a known type of machine 10 for producing such pellets or particles. This machine 10 is preferably of a known type capable of producing either particles or pellets having a rounded or somewhat rounded configuration or having comparatively sharp edges and corners. When the invention is to be utilized in connection with abrading a surface or for a similar purpose it is considered that preferably such particles or pellets be formed by the machine 10 so as to have a tetrahedral shape since when particles or pellets are of such a shape they are believed to have a maximum of sharp edges and corners per unit of weight.

However, cubicle particles, cylindrical particles and the like may also be employed for abrading type purposes. When the invention is to be utilized in obtaining a peening or polishing type action at a surface preferably the pellets or particles produced by the machine 10 are ball shaped although they may also be of other shapes of a similar nature characterized by the absence of comparatively sharp edges and corners.

The machine 10 selected to be used in practicing the invention should be carefully selected so as to produce particles of as high a density as reasonably possible since the density of the particles or pellets used is related to the achievement of preferred results with the present invention. Some commercial equipment for producing dry ice particles or pellets produce such particles or pellets having a density of about 85 pounds per cubic foot. Much more effective results can be achieved utilizing another commercial machine 10 which will produce particles or pellets having a density of about 95 pounds per cubic foot. It is considered that the machine 10 chosen should produce particles or pellets having at least 90 percent of the theoretical density of the pelletized material used.

In general the sizes of the pellets or particles produced by the machine 10 should correspond to the sizes of the particles or pellets such as are employed in conventional sandblasting type operations. For the particles or pellets used to be sufficiently large so as to be effective in causing an effect on a surface as the invention is practiced it is considered that these particles should be at least 1/16 inch (.16 cm.) in their largest dimension. On the other hand if the particles or pellets employed are greater than about ⅜ inch (0.93 cm.) in their largest dimension it will be difficult to utilize such particles in practicing the invention. Also such large particles, particularly when they are comparatively hard, may tend to dent a surface being treated as the process is practiced. The sizes of such particles are specified in this discussion with reference to the largest dimensions of such particles in this specification because it is normally easiest to size particles using conventional screens which effectively separate particles according to their largest dimensions.

It is to be noted that the invention is not limited to the use of a machine 10 which will produce pellets or particles of dry ice. The machine 10 used may be of a type adapted to produce pellets or particles of other materials which will sublime after being directed against a surface as herein indicated. A number of such materials are listed on page C-686 of the text "Handbook of Chemistry and Physics", 48th Edition, published by the Chemical Rubber Company of Cleveland, Ohio 44128, U.S.A., copyright 1967. Among the materials indicated in this text which are capable of being used so as to sublime at various ambient temperatures at which the invention may be practiced are the compounds 1-chloro-acetophenone, benzoyl acetone, p-bichloro benzene and other related halogenated benzenes such as 1,2,4-, trichloro benzene, biphenyl, naphthalene, various phenols and the like. The material used with any particle or pellet employed in practicing the invention preferably should be free from any contaminant or contaminants which might tend to result in the particles or pellets employed agglomerating or clumping together. As an example of this when dry ice particles are used it is considered preferable for such particles to be substantially "pure" carbon dioxide. It is considered that even the presence of small quantities of water within dry ice particles or pellets may have a detrimental effect by causing such particles or pellets to adhere together to a limited degree. However, it is possible to coat such particles or pellets with a material such as diatomaceous earth so as to minimize the possibilities of such pellets adhering to one another. Expedients of this type are, however, not preferred with the invention since any such coating material may result in a cleanup problem and/or an atmospheric pollution problem, particularly if any significant amounts of coating material are used.

In accordance with the invention the pellets or particles produced by the machine 10 are transferred through a conduit 12 containing a control valve 14 to a storage hopper 16 which is utilized as a surge tank from which these pellets or particles are dispensed through a Y-fitting 18 into a principal line or conduit 20. Preferably the conduit 12 should be as short as reasonably possible so that the total time that a pellet or particle will be in this conduit 12 is minimized as much as possible. Similarly, normally the hopper 16 will be of a comparatively small size and will be operating so that no pellet or particle will be within this hopper 16 any longer than is reasonably necessary in practicing the invention.

These time considerations are dictated by a recognition that the sublimation of the particles utilized should be minimized as much as possible so that any particles or pellets produced will have substantially or nearly their initial weight as they impinge against a surface as the invention is practiced. Such minimization of sublimation is particularly important when the particles employed have comparatively sharp edges and corners. It has been observed that the sublimation which takes place from a particle having such a configuration will normally tend to round off such corners and edges.

When such rounding occurs at the edges and corners of a particle or pellet the effectiveness of such a particle or pellet in causing surface abrasion is significantly decreased. Although it is difficult to precisely measure the amount of rounding which can occur without such abrasion causing characteristics being significantly altered for practical purposes it is considered that any particle or pellet used should lose no more than 10% and preferably no more than 5% of its initial weight as a result of sublimation between the time when such a particle or pellet is produced and the time which such a particle or pellet impinges against a surface.

To a degree such sublimation may be controlled by not only limiting what may be referred to as the "dwell time" within the conduit 12 and the hopper 16 but by in addition providing the conduit 12 and the hopper 16 with cooling jackets 22 of conventional design which are intended to lower the temperature within the conduit 12 and the hopper 16 to well below the triple point of the material used in the pellets or particles. Such a "triple point" is defined as the temperature and pressure at which the solid, liquid and vapor of a substance are in equilibrium with one another.

Normally there will be no significant problem in keeping the temperature of particles or pellets, and in particular the temperature of dry ice particles or pellets low enough to be within the desired range. Obviously the pressure present in the hopper 16 and, depending upon specific design details, in all or part of the conduit 12, will be important in maintaining the particles or pellets in minimizing weight loss through sublimation. The hopper 16 is normally pressurized through the use of a gas under pressure introduced into the this hopper 16 through a line 24. The pressure of such gas will normally be sufficiently adequate so as to tend to promote movement of the particles or pellets through the fitting 18 into the conduit 20. The gas used to pressurize the hopper 16 is preferably cool enough and/or is cooled to a temperature at which it will not promote sublimation by heating the particles or pellets within this hopper 16.

The movement of pellets or particles through the conduit 12 and into the hopper 16 and to a degree from this hopper 16 will frequently tend to cause the generation of static charges on these pellets or particles. The development of such charges is considered to tend to promote the pellets or particles to agglomerate or join together. This is undesirable because if the pellets or particles tend to adhere to one another they will not normally move in the desired manner from the hopper 16 to the fitting 18. On occasion such adherence between the individual particles or pellets may even tend to prevent any particle or pellet movement from the hopper 16 to the fitting 18.

Such static caused adherence is preferably minimized in accordance with this invention by locating within the hopper 16 and on occasion within the conduit 12 a plurality of alpha particle static eliminators 26. The precise number and locations of such eliminators 26 which are used in any installation are preferably determined on an empirical basis. Such eliminators 26 are relatively small devices which can normally be installed with a minimum of difficulty. These devices do not require any external power source and operate effectively over a relatively prolonged period. Suitable devices of this category are commercially available and are utilized in other applications.

It is also preferred to locate within the hopper 16 a conventional mechanical agitator 28 which will continuously stir the particles or pellets within this hopper 16. The particular agitator 28 illustrated is a mechanical stirring blade of conventional design. Such a blade will constantly keep the particles or pellets in a state of agitation so as to prevent any bridging of such particles or pellets adjacent to the fitting 18 and will tend to constantly move these particles or pellets so that there will always be a supply of them ready for use adjacent to the fitting 18. If desired other agitation type devices than a stirrer can, of course, be employed.

In order to guard against the possibility of particles or pellets agglomerating within and/or forming a bridge-like structure blocking off the interior of the fitting 18 it is considered most desirable to use an agitator in connection with this fitting 18, particularly in those circumstances when a valve 30 is installed within the fitting 18 for the purpose of regulating the flow of particles or pellets through this fitting 18. Because of the nature of the normal type of fitting used as the fitting 18 a stirrer type agitator cannot be utilized in conjunction with this fitting 18. It is considered preferable to use with the fitting 18 a small vibratory agitator 32 which will constantly apply a shaking action to the fitting 18 of sufficient magnitude so as to prevent any hangup of material within this fitting 18.

The particles or pellets which pass through the fitting 18 into the conduit 20 are caught up with the stream of compressed gas moving through the conduit 20 and are agitated by the turbulence of such gas to such an extent that material hangup or agglomeration is normally not a problem after the particles and the compressed gas are mixed with one another. Normally the gas used within any of the different sublimable particles or pellets capable of being employed with the invention will be common air.

Most satisfactory results are considered to be achieved using compressed air at a pressure from about 40 to about 200 pounds per psig. When lower pressures are used the momentum of a particle hitting against a surface as the invention is practiced will normally tend to be undesirably small to accomplish any significant affect on the surface. If on the other hand a gas at a higher pressure is used it is considered that the practice of the process will be impeded by the usual problems encountered in conveying relatively high pressure fluids. The relative quantities of particles or pellets and of compressed gas which should be used together can be varied between comparatively wide limits.

In general the rate at which pellets or particles move through the fitting 18 should be correlated with the volume of compressed gas moving through the conduit 20 so that the gas stream is not overloaded with particles or pellets to an extent that there is danger of such particles or pellets not being entrained within and not moving with such a stream of compressed gas. In general the higher the loading of such a stream of such a compressed gas with particles or pellets the more efficient the results obtained with the invention so long as the loading is not sufficiently high so as to cause accumulations or so as to cause sufficient friction between the individual particles or pellets to prevent them from obtaining a relatively high velocity.

In accordance with this invention the conduit 20 is normally employed to convey such particles or pellets to an elongated flexible tube 34 which in turn is used to convey them through a nozzle 36. This tube 34 is flexible so as to permit the nozzle 36 to be directed as desired. It is preferably formed so that it will not expand to any significant extent at the pressures used in the conduit 20. Further, it is preferably formed out of a composition such as reinforced silicone rubber which is not significantly affected by the temperatures of the particles and pellets present.

It is considered that the nature of the nozzle 36 is quite important in obtaining optimum results with the present invention. Preferably this nozzle 36 is of a type frequently referred to as a "supersonic" nozzle having an internal shape which is contoured in the manner illustrated so as to produce a local static pressure at the exit of the nozzle equal to the static pressure in the surrounding environment. Such a supersonic nozzle is related to what may be defined as a "venturi" nozzle. It is considered that there is a degree of confusion as to the terminology commonly employed to designate nozzles of these types.

Technically a venturi nozzle is constructed so as to consist of a short, narrow center section and widened, tapered ends. The ends and the center section in a venturi nozzle are curved slightly. As a practical matter any nozzle of this converging-diverging type may be used to obtain reasonable results in accordance with this invention. A supersonic nozzle of the type used with this invention can be regarded as a particular species of a venturi or venturi type nozzle.

The use of such a supersonic nozzle is preferred in order to maximize the velocity at which particles or pellets are emitted from the nozzle 36. Whenever pellets are moved in a stream of compressed gas as indicated the velocity of the pellets is a direct function of the velocity of the gas stream since the accelleration of the pellets is produced by the action of the stream force. The constriction 38 between the inlet 40 and the outlet 42 of the nozzle 36 has the effect of increasing the velocity of the carrier gas stream so that the pellets used are ejected at as high a velocity as reasonably possible.

The precise configuration of the nozzle 36 to achieve such a maximization of exit velocity will vary depending upon the pressure supplied to the conduit 20. Since the pressure losses occuring as a result of the usual flow considerations will vary depending upon factors such as the length of the tube 34, the manner in which this tube 34 is curved or curled in use and various other related considerations it is considered that it would be impractical to set forth herein the precise shape and configuration of a specific supersonic nozzle which is best utilized with the invention. Preferably in any specific application various different supersonic nozzles corresponding to the nozzle 36 shown will be tested so as to obtain a maximum velocity of the particles or pellets used for any specific particle loading of the gas stream.

If desired the nozzle 36 employed can be provided with a conventional cooling jacket 44 corresponding to the jacket 22 previously described for the purpose of cooling so as to minimize sublimation within this nozzle 36. Although the reason behind the use of the jacket 44 has merit it is not considered that it is normally necessary to utilize a jacket corresponding to the jacket 44. This is because the total time when any specific particle or pellet is within the nozzle 36 is so limited that the chances of such a particle heating and subliming to any significant extent are minimized. Similarly it would be possible to locate a cooling jacket (not shown) around the tube 34 but this is not considered normally desirable or necessary because of practical problems in connection with the construction of a cooling jacket to be utilized with a flexible tube or hose. Further, the dwell time of any particle or pellet within the tube 34 is normally sufficiently short so that no significant sublimation will take place within the tube 34.

This matter of the dwell time of a particle or pellet within the "system" described in the preceding is considered important in obtaining the preferred results of the invention. As indicated in the preceding it is considered that the total weight loss of a particle or pellet should be restricted in accordance with this invention. This is to maximize the effect of such a particle or pellet at a surface so that the pellet or particle weighs as much as possible when it is discharged from the nozzle 36. This, of course, also minimizes the waste of material as far as the process is concerned to the loss of such material as a gas prior to a pellet or particle being employed. In addition, such minimization of total weight loss is considered preferable in enabling the particles or pellets to have substantially unaltered edge and corner configurations when they are utilized in abrading or similarly treating surfaces.

In achieving effective results with the invention it is considered that the weight loss of pellets or particles as indicated can normally be controlled by constructing the complete "system" described so that no individual pellets or particles are within the system for a period of more than two minutes. It is considered preferable, however, for the complete system to be constructed so that no particles or pellets are within the system for more than about 1 minute in order to minimize weight loss.

The individual particles or pellets are, of course, ejected from the nozzle 36 toward a surface 46 so as to hit against and impinge against this surface 46 so as to accomplish whatever surface treatment is desired in a particular application. Because of the nature of the invention this surface treatment can be of any type previously accomplished with known sandblasting processes. To avoid possible problems of gaseous material resulting from the sublimation of spent pellets or particles which have hit against the surface 46 it is preferable to provide moderate air circulation in the area generally between and around the nozzle 36 and the surface 46. On occasion, however, it may be desirable to enclose such an area so as to recover sublimed material in accordance with various known or conventional techniques.

I claim:

1. A process in which solid pellets are entrained in a stream of pressurized gas in a conduit and are propelled by the gas through a nozzle out of the conduit against a surface in which the improvement comprises:

said particles being solid particles of a material which will sublime after engaging the surface, said nozzle being a supersonic nozzle contoured to maximize the flow momentum of the particles by producing a total static pressure at the exit of the nozzle which was equal to the static pressure in the surrounding environment, said particles are in the equipment utilized to practice said process a sufficiently short time so that no more than about 10 percent by weight is lost from said particles during the time from when said particles are introduced into the equipment for practicing the process to when said particles engage said surface.

2. A process as claimed in claim 1 in which:

said particles are in the equipment utilized to practice said process a sufficiently short time so that no more than about 5 percent by weight is lost from said particles during the time from when said particles are introduced into the equipment for practicing the process to when said particles engage said surface.

3. A process as claimed in claim 1 wherein:

said particles are of a tetrahedral shape and have sharp edges and corners, the largest dimension of said particles is from about 1/16 inch to about ⅜ inch, the density of said particles is at least about 90 percent of the theoretical density of said particles, said pressurized gas is at a pressure of from about 40 to about 200 psig., said particles are in the equipment utilized to practice said process a sufficiently short time so that no more than about 5 percent by weight is lost from said particles during the time from when said particles are introduced into the equipment for practicing the process to when said particles engage said surface.

4. A process as claimed in claim 1 in which:

said pellets are held in a hopper and are dispensed from said hopper into a stream of pressurized gas, said pellets are continuously subjected to alpha particle radiation within said hopper to an extent sufficient to prevent agglomeration within said hopper,

5. A process as claimed in claim 1 in which:

said pellets are carbon dioxide pellets, said pellets are held in a hopper and are dispensed from said hopper into said stream of pressurized gas, said pellets are continuously agitated and are continuously subjected to alpha particle radiation to an extent sufficient to prevent particle agglomeration when within said hopper, said particles are of a tetrahedral shape and have sharp edges and corners, the largest dimension of said particles is from about 1/16 to about ⅜ inch, the density of said particles is at least about 90 percent of the theoretical density of said particles, said pressurized gas is at a pressure of from about 40 to about 200 psig., said particles are in the equipment utilized to practice said process a sufficiently short time so that no more than about 5 percent by weight is lost from said particles during the time from when said particles are introduced into the equipment for practicing the process to when said particles engage said surface.

* * * * *